US005855538A

United States Patent [19]

Argabright

[11] Patent Number: 5,855,538

[45] Date of Patent: Jan. 5, 1999

[54] LEG EXTENSION MACHINE WITH UPWARDLY CURVED TRACKS

[76] Inventor: John Argabright, 7432 Rolling River Pkwy, Nashville, Tenn. 37221

[21] Appl. No.: 835,273

[22] Filed: Apr. 8, 1997

[51] Int. Cl.[6] ..... A63B 23/10

[52] U.S. Cl. ..... 482/70; 482/79

[58] Field of Search ..... 482/51, 52, 53, 482/57, 79, 80, 111, 112, 70, 54, 148; D21/685, 686, 668

[56] References Cited

U.S. PATENT DOCUMENTS

| | | | |
|---|---|---|---|
| 2,544,106 | 3/1951 | Ray | 482/112 |
| 4,605,220 | 8/1986 | Troxel | 482/79 |
| 4,659,077 | 4/1987 | Stropkay | 272/97 |
| 4,728,101 | 3/1988 | King | 272/130 |
| 4,743,015 | 5/1988 | Marshall | 272/97 |
| 4,844,454 | 7/1989 | Rogers | 272/126 |
| 4,867,443 | 9/1989 | Jensen | 272/97 |
| 5,000,442 | 3/1991 | Dalebout et al. | 270/70 |
| 5,002,271 | 3/1991 | Gonzales | 272/134 |
| 5,044,355 | 9/1991 | Reopelle | 128/25 |
| 5,064,190 | 11/1991 | Holt | 272/97 |
| 5,066,004 | 11/1991 | Jones | 272/134 |
| 5,267,930 | 12/1993 | Henes | 482/139 |
| 5,277,677 | 1/1994 | Terauds | 482/80 |
| 5,279,530 | 1/1994 | Hess | 482/70 |
| 5,290,211 | 3/1994 | Stearns | 482/53 |
| 5,304,106 | 4/1994 | Gresko | 482/80 |
| 5,358,468 | 10/1994 | Longo et al. | 601/33 |
| 5,507,711 | 4/1996 | Richardson | 482/112 |
| 5,575,740 | 11/1996 | Piaget et al. | 482/51 |

*Primary Examiner*—Stephen R. Crow
*Attorney, Agent, or Firm*—Dougherty & Associates

[57] ABSTRACT

An exercise device that allows the user to extend each leg separately from a sitting position. A pair of upwardly curved tracks (20) are affixed to horizontal base members (10) by the rear support members (16) and to vertical base members (12) by the top support members (18). Tracks (20) extend upwardly toward the forward end of the invention. The two foot plates (31) are affixed to tracks (20) by the foot plate attachments (30) to move forward and rearward. A pair of foot supports (32) are affixed to foot plates (31), wherein they can adjustably fit to a human being's feet as the legs are extended. Embodiments include different options for supplying resistance to the movement of the foot supports, including the use of hydraulic cylinders (42) or straps (36). Other embodiments include a means for carrying the device and for collapsing it for easy storage. It can easily be used in many environments including at a desk or on a sofa.

18 Claims, 9 Drawing Sheets

LEG EXTENSION MACHINE WITH UPWARDLY CURVED TRACKS

BACKGROUND—FIELD OF THE INVENTION

This invention relates to an exercise device, and more particularly pertains to a new exercise device wherein the user extends each leg separately along upwardly curved tracks.

BACKGROUND—DESCRIPTION OF PRIOR ART

Physical fitness and various forms of exercise have increased considerably in the past number of years as well as the use of various devices permitting exercise in a confined area such, as in a gymnasium, in a basement, or in a separate room of a dwelling. Recent studies have shown that doing relatively low impact exercises over a longer period of time is more efficient for weight loss than a vigorous exercise over a shorter period of time. Various indoor exercise devices have been heretofore been known in the art which provide cardiovascular development, muscular development, weight loss, and therapeutic movement. In this connection, the following patents are thought to be particularly relevant to the instant invention.

Prior art examples may be found in U.S. Pat. No. 4,844,454 to Rogers (1989) wherein a portable, manually operable knee exerciser permits selective flexure of a knee relative to a thigh, wherein the organization is strapped to a thigh portion and a lever is pivoted relative to the thigh portion to permit flexure of the knee. While the device above isolates a leg for rehabilitation, it does not provide variable resistance or a significant aerobic benefit. It does not utilize both legs. Basically, its use is limited to the rehabilitation of a leg.

U.S. Pat. No. 5,358,468 to Long, Vukich, and Genova (1994), provides an upper and lower frame assembly being securable around a thigh and a shin of a user's leg above and below a knee joint, and a pair of separate torque unit assemblies which independently adjust the amounts of work required to be exerted respectively in flexion and extension of the user's leg. While the device above allows for a means for variable resistance, its utility is limited to the rehabilitation of a leg. It does not allow for use of two legs for an aerobic or weight loss benefit.

U.S. Pat. No. 5,044,355 to Reopelle (1991), provides a manually operable leg exercise apparatus which permits selective and balanced exercise of an injured knee joint utilizing an opposing knee to counter-balance motion during movement of the damaged knee joint relative to an individual's body while lying flat on the ground. The patent above does not allow the user to exercise from a sitting position. Therefore, the environments that the device can be used are limited. It also fails to provide a means for variable resistance.

U.S. Pat. No. 5,279,530 to Hess (1994), provides a leg exercising apparatus including independently movable foot pedals that slide along guide rails, wherein elastic cords extending between the frame and the carriages provide elastic resistance to the leg motion. The user lays down on his or her back and extends each leg upwardly along the inclined rails. While the device above provides resistance, it is only in the forward motion of the leg not in the backward motion. It also has the disadvantages associated with devices that require the user to be in a horizontal position.

U.S. Pat. No. 5,002,271 to Gonzales (1991) and U.S. Pat. No. 5,267,930 to Henes (1993), provides a chair or bench for leg extension exercises with a pivotal leg-engaging apparatus having means for providing resistance. The devices above and those like them are not compact or easily transported. They do not engage each leg independently. They do not provide for the user an aerobic benefit or a significant weight loss. They may cause muscle and joint strain.

U.S. Pat. No. 5,066,004 to Jones (1991), provides a bench for leg extension exercises. It uses weights for resistance and independently moving levers with pads. While the device above does provide for independent movement of the legs, it does not overcome the other disadvantages that are associated with the devices in the previous paragraph.

There are various exercise devices that incorporate the reciprocating motion of foot pads along parallel guide rails, wherein the user is standing upright. The purpose of many of these is to simulate cross country skiing, including U.S. Pat. No. 5,000,442 to Dalebout and Ellis (1991), and U.S. Pat. No. 4,659,077 to Stropkay (1987). These types of devices are normally not compact or easily transported. The user must be in a vertical position. Therefore, the environments in which they can be used are limited.

OBJECTS AND ADVANTAGES

Accordingly, several objects and advantages of the present leg exerciser are:

a) to provide an exercise device having a pair of foot pads that slide about two rails as the user extends each leg;

b) to provide an exercise device which is safe without muscle or joint strain;

c) to provide an exercise device which has an adjustable degree of resistance;

d) to provide an exercise device which can be used from a sitting position;

e) to provide an exercise device which allows the user to extend each leg in a reciprocating fashion;

f) to provide an exercise device which can be used in the rehabilitation of injured muscles or joints;

g) to provide an exercise device which aerobically conditions the user's cardiovascular system;

h) to provide an exercise device which is an efficient method of weight loss;

i) to provide an exercise device which accommodates users of different heights, weights, and levels of physical fitness;

j) to provide an exercise device which is of relatively inexpensive construction enabling it to be purchased by individuals for home use;

k) to provide an exercise device which is quiet in operation;

l) to provide an exercise device which occupies a minimum amount of space and can be used in many types of environments, for instance, while sitting at a desk or on a couch;

m) to provide an exercise device which is suited for use by beginners or by persons with a disability or injury, as it does not require a large degree of skill or balance;

n) to provide an exercise device which is compact and easy to transport;

o) to provide an exercise device which may be easily and efficiently manufactured and marketed;

p) to provide an exercise device which is of a durable and reliable construction.

Still further objects and advantages will become apparent from a consideration of the ensuing description and drawings.

DRAWINGS FIGURES

In the drawings, closely related figures have the same number but different alphabetic suffixes.

REFERENCE NUMERALS IN DRAWINGS

| | | | |
|---|---|---|---|
| 10 | horizontal base frame | 12 | vertical base member |
| 13 | rear cross support | 14 | front cross support |
| 15 | left support attachment | 16 | rear support member |
| 17 | right support attachment | 18 | top support member |
| 20 | track | 28 | rear strap attachment |
| 29 | front strap attachment | 30 | foot plate attachment |
| 31 | foot plate | 32 | foot support |
| 33 | rear track bearing member | 34 | guideway |
| 35 | front track bearing member | 36 | strap |
| 37 | rear bearing member | 39 | front bearing member |
| 40 | base frame pivot | 42 | hydraulic cylcinder |
| 44 | rod | 46 | foot plate pivot |
| 48 | resistance control knob | 50 | handle |
| 52 | bolt attachment | 54 | bolt |
| 56 | spring | 58 | strap harness |

SUMMARY

In accordance with the present invention, a leg exercise device comprises a base frame having front and rear ends, a pair of upwardly curved tracks mounted on the base frame, and two foot supports mounted for sliding motion, one on each of the two said tracks.

DESCRIPTION AND OPEATION—FIGS. 1 TO 6

The objects, advantages, and features of the leg exerciser will become more apparent by reference to the drawings which are appended hereto and wherein like numerals indicate like elements and wherein an illustrative embodiment of the leg exerciser is shown.

Figure 1:
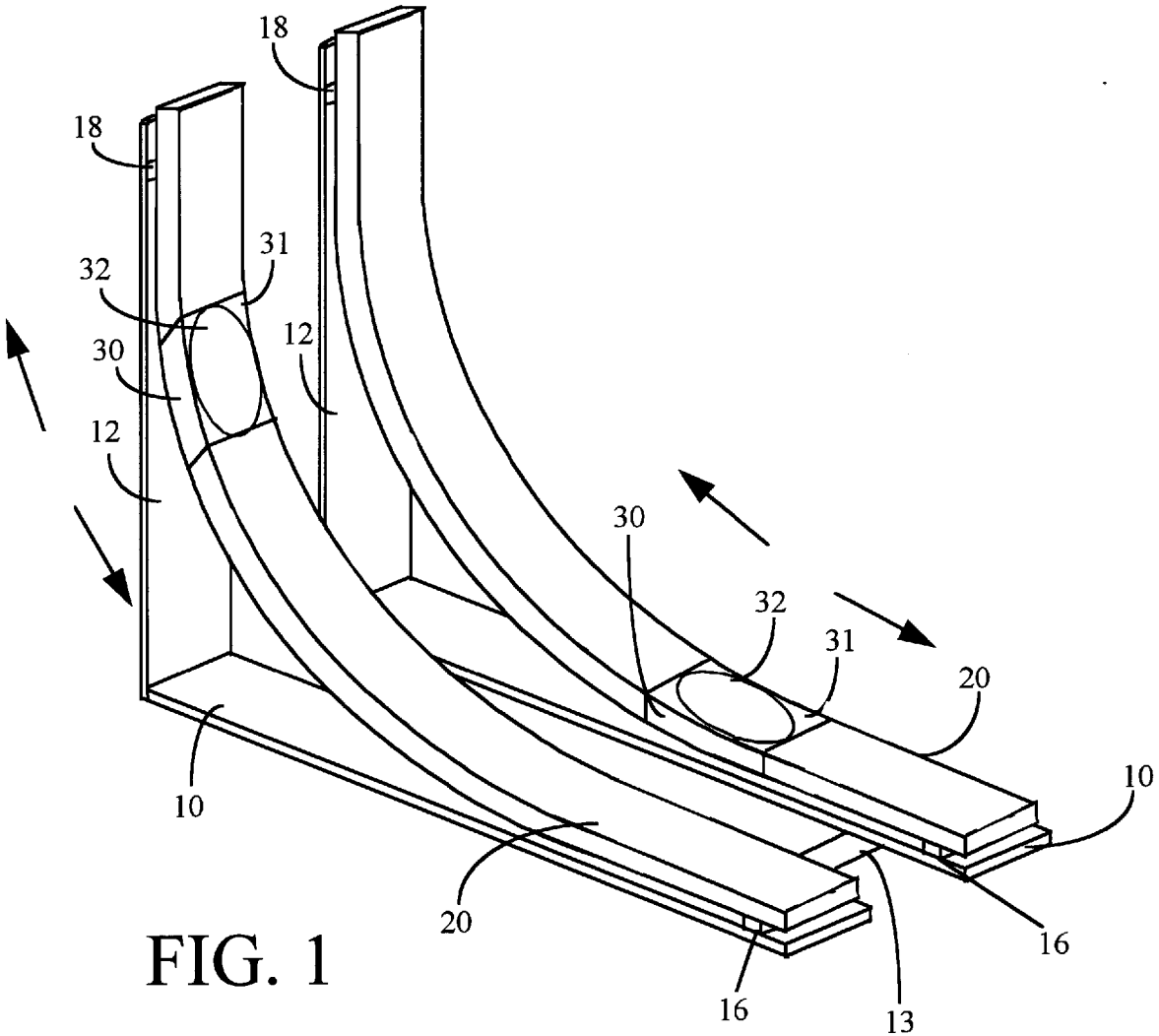
FIG. 1 is a perspective view of the leg exerciser.
Figure 2:
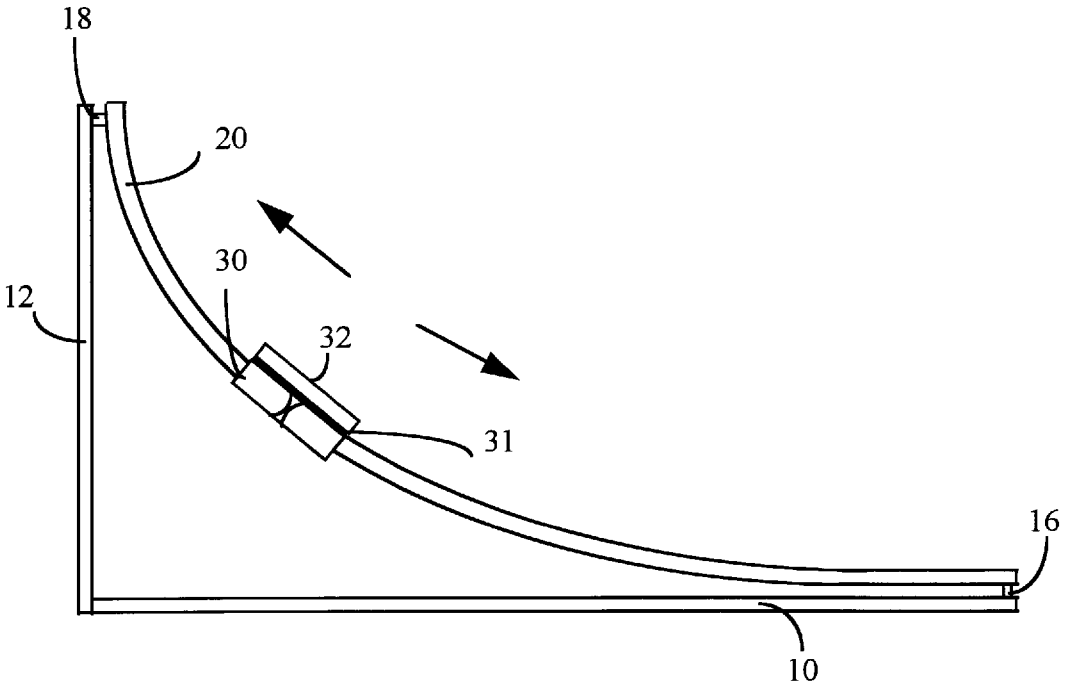
FIG. 2 is a side view of the device in FIG. 1.

A typical embodiment of the leg exerciser is illustrated in FIGS. 1 and 2. The base structure is illustrated as having a pair of rectangular, horizontal base members 10 connected by a rear cross support 13 and a front cross support 14. The first horizontal base member 10 is spaced from the second horizontal member 10 a pre-selected distance and in substantial alignment. Preferably, they are essentially parallel. This space would be equal to that of the shoulder width of an average human begin. Two rectangular vertical base members 12 are attached to the forward ends of horizontal base members 10.

A pair of rectangular upwardly curved tracks 20 are affixed to horizontal base members 10 by rear support members 16 and to vertical base members 12 by top support members 18. Tracks 20 extend upwardly toward the forward end of the leg exerciser. This construction forms a pair of parallel rails. Two foot plates 31 are affixed to tracks 20 by foot plate attachments 30 to move forward and rearward. A pair of foot supports 32 are affixed to foot plates 31, wherein they can adjustably fit to a human being's feet in a conventional way as the legs are extended.

In using the leg exerciser, the user places the device in front of him or her. Typically the user sits in a chair and places his or her feet in each of foot supports 32. The user extends each leg in a forward and rearward motion, typically in a reciprocating fashion, along tracks 20. The upward curvature of tracks 20 generally corresponds to the natural swinging arc of a human leg as it pivots about its knee joint. This provides for a safe exercise without fear of muscle strains or joint sprains. Also, there would be no problems with maintaining balance.

The resistance, according to the particular embodiment of the leg exerciser, causes the user to exert physical effort while moving foot supports 32 along tracks 20 in both the forward and rearward directions. The continuous nature of this resistance provides a smooth and steady workout for the user, which utilizes all of the muscles of the leg. Because the leg exerciser is manually driven, the user can alter the intensity and duration of his or her efforts. The length and curvature of track 20 are such that a user of any height can use the leg exerciser. A taller user starts his or her leg extensions closer to the rear end of the device and finish near the top end, while a shorter person's starting and ending points are not as close to the ends of tracks 20. The curvature of track 20 will accommodate any user because of the common angle at which the leg pivots at the knee joint.

Figure 3:
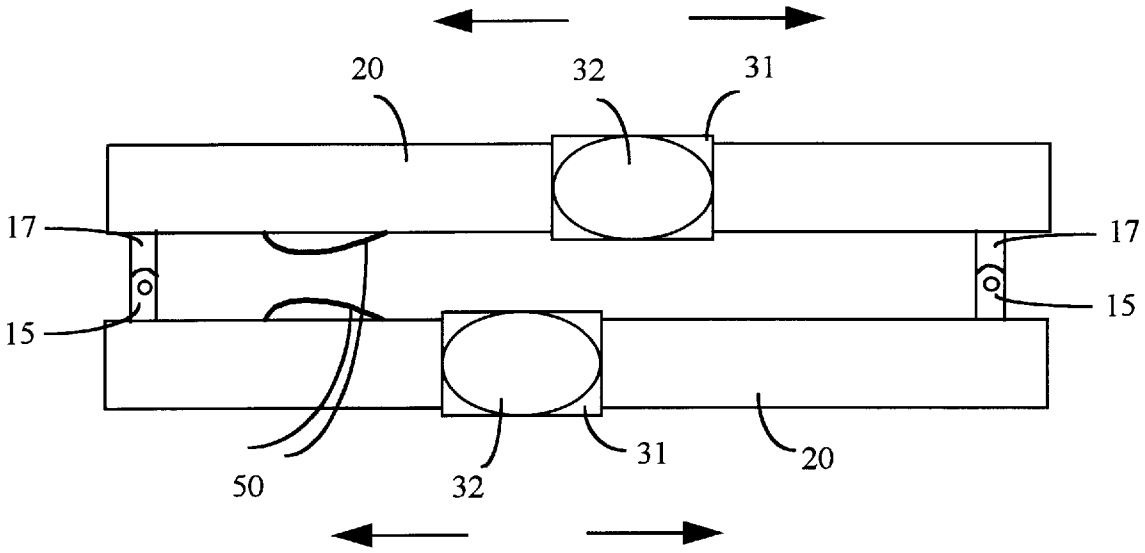
FIG. 3 is a top view of the device in FIG. 1.

FIG. 3 shows an embodiment of the leg exerciser wherein there are two handles 50 attached to the forward parts of horizontal base members 10. In this embodiment, left support attachments 15 are affixed to the inward side of the left horizontal base frame 10 at the forward and rearward ends. Right support attachments 17 are affixed to the inward side of the right horizontal base frame 10. Each left support attachment 15 would be connected to its corresponding right support attachment 17 by a common method of holes and pegs. Accordingly, horizontal base frames 10 could be detached from one another. In using handles 50 for transport, the user would first detach left support attachments 15 from right support attachments 17. Then, he or she would turn horizontal base members 10 upside-down and grasp handles 50. Handles 50 are placed at the forward ends of the device because more of the weight is toward that end. This would make the weight evenly distributed about handles 50. It is designed for the user to carry the device to his or her side during transport. Having horizontal base frames 10 detached also makes the leg exerciser more compact for storage.

Figure 4A:
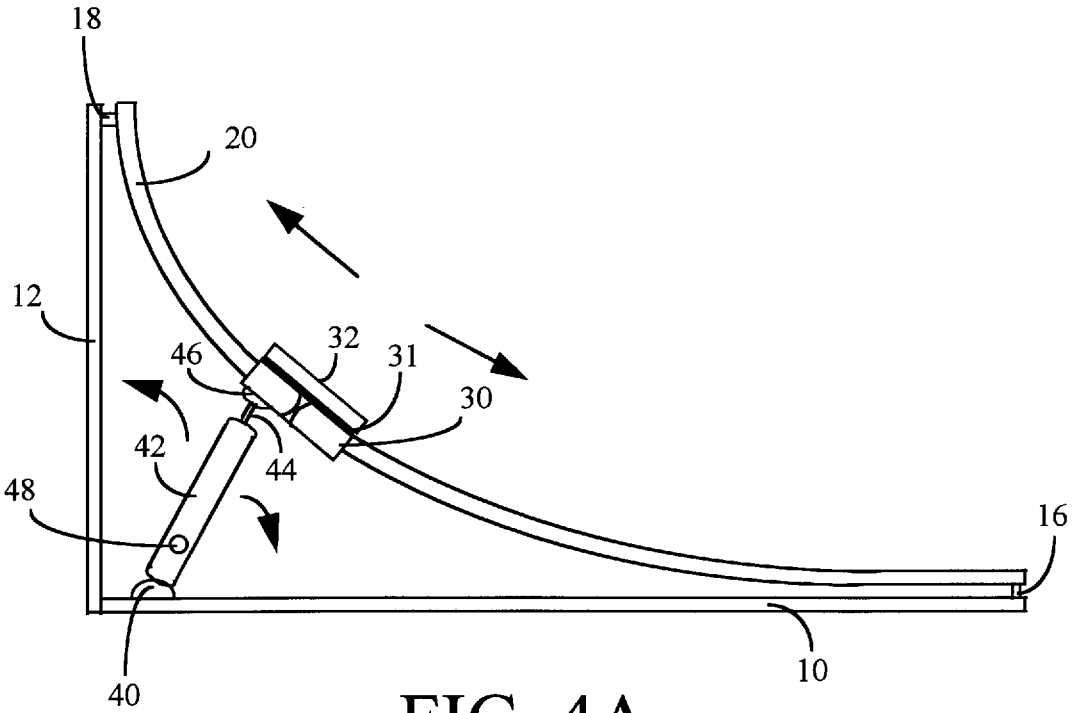
FIG. 4A to 4C show side views of the device in FIG. 1, wherein resistance is provided by hydraulic cylinders.
Figure 4B:
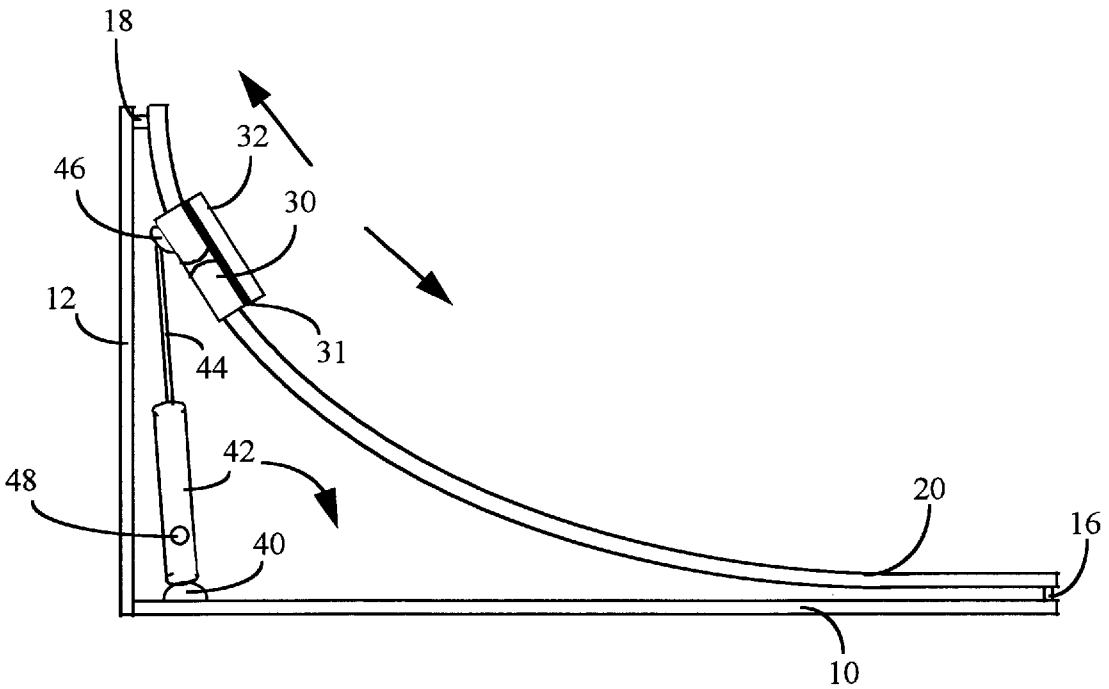
Figure 4C:
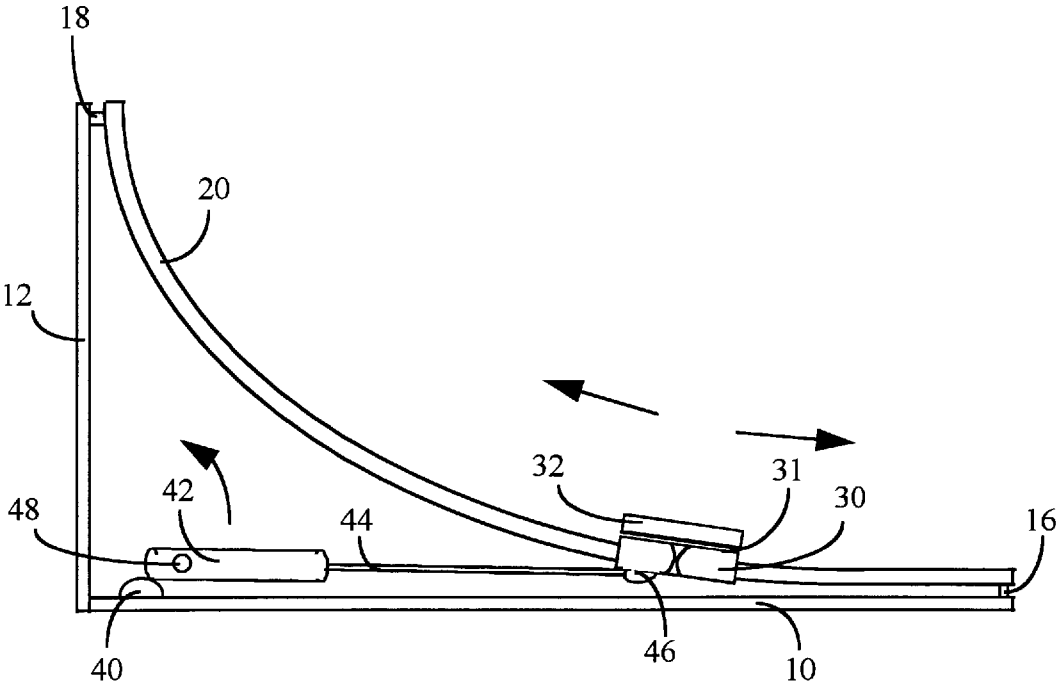

FIGS. 4A to 4C show the preferred embodiment of the leg exerciser with an alternate method of resistance. The resistance structure is illustrated as having a base frame pivot 40 attached to the forward end of each horizontal base member 10. Hydraulic cylinders 42 are attached at their base ends to base frame pivots 40, and rods 44 thereof are attached to foot plate pivots 46. Foot plate pivots 46 are affixed to the lower side at the forward end of each foot plate attachment 30. Resistance control knobs 48 are affixed to the outward side of hydraulic cylinders 42. Resistance control knob 48 dictates the ease at which rod 44 can be pushed into and pulled out of hydraulic cylinder 42.

The illustrations show the action of hydraulic cylinder 42 and foot support 32 in different positions as the user moves his or her foot in a forward and rearward direction. Hydraulic cylinder 42 with its rod 44 moves smoothly from a horizontal to a vertical position as foot support 32 is pushed up track 20. When foot support 32 is at the rearward end of track 20, hydraulic cylinder 42 is in a horizontal position with its rod 44 fully extended. When foot support 32 is in the middle of track 20, hydraulic cylinder 42 is at a 45 degree angle and rod 44 is pushed fully into hydraulic cylinder 42. And finally, when foot support 32 is at the forward end of track 20, hydraulic cylinder 42 is in a vertical position with rod 44, once again, fully extended. During the full range of motion, hydraulic cylinder 42 moves about base frame pivot 40 and foot plate pivot 46. Hydraulic cylinder 42 provides resistance when rod 44 is pulled out and pushed in which provides a smooth, continuous resistance for the user as he or she extends and contracts each leg. By turning resistance control knob 48 on each hydraulic cylinder 42, the user increases or decreases the amount of force required to move foot supports 32 in a forward and rearward direction. This also allows the user to have more resistance for one leg than the other, which may needed during rehabilitation.

Figure 5:
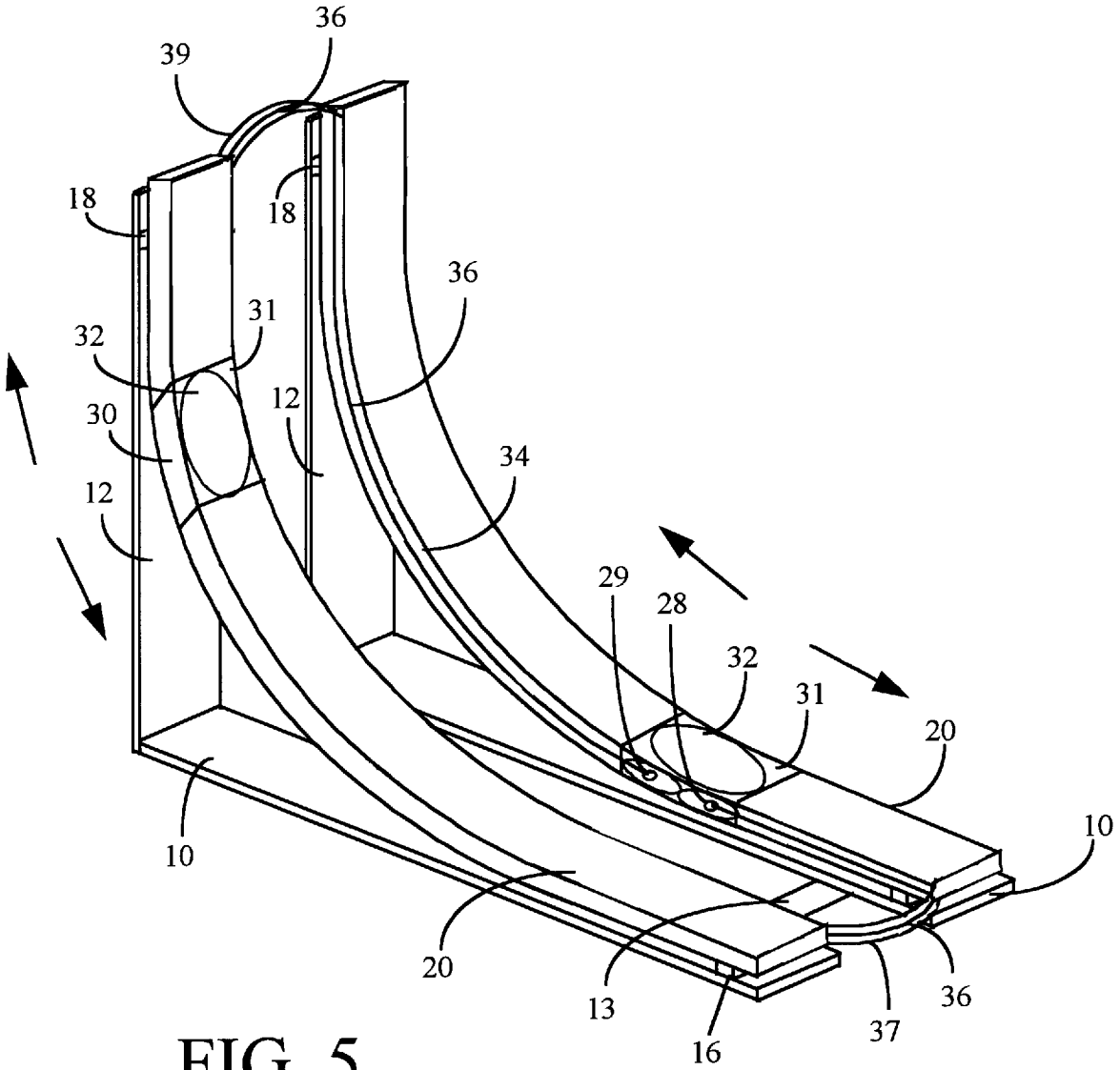
FIG. 5 is a perspective view of the device in FIG. 1, wherein the resistance is provided by two straps and two U-shaped bearing members.

FIG. 5 shows an embodiment of the leg exerciser with an alternate method of resistance. It is illustrated as having a front strap attachment 29 and a rear strap attachment 28 affixed to each foot plate attachment 30 on the side that faces inwardly. A front bearing member 39 and a rear bearing member 38 join tracks 20 at each end, the convex side of each bearing member 37, 39 facing outwardly. One end of a strap 36 is attached to a front strap attachment 29 on one track 20, while the other end of strap 36 is attached to front strap attachment 29 on the other track 20. Strap 36 extends forward along one track 20 in a guideway 34 and around front bearing member 39, then back down the other track 20 in guideway 34 in a rearward direction. One end of another strap 36 is attached to rear strap attachment 28 on one track 20, while the other end of strap 36 is attached to rear strap attachment 28 on the other track 20. Strap 36 is extended rearward along one track 20 in guideway 34 and around rear bearing member 37, then back up the other track 20 in guideway 34 in a forward direction.

In this embodiment, resistance to the user's movement of foot supports 32 in a forward and rearward direction is provided by friction created as straps 36 are pulled around the curved surfaces of front 39 and rear 37 bearing members. It will be appreciated that as one foot support 32 is moved rearwardly on its track 20, by reason of interconnecting strap 36, the other foot support 32 is forced forwardly on its track 20. This provides a smooth, consistent workout for the user.

Figure 6:
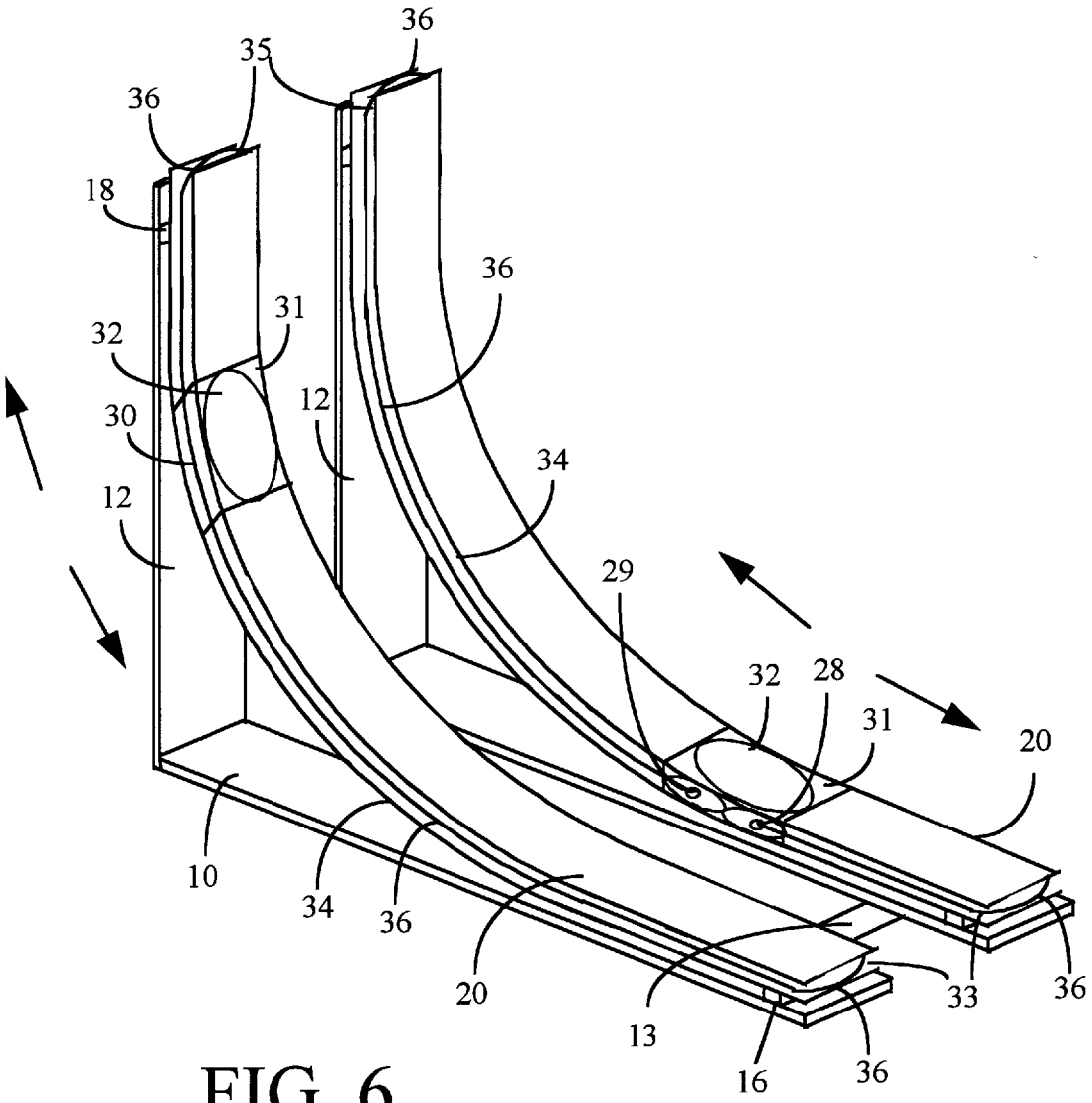
FIG. 6 is a perspective view of the device in FIG. 1, wherein the resistance is provided by two straps and bearing members on each end of the two upwardly curved tracks.

FIG. 6 shows an embodiment of the leg exerciser with an alternate method of resistance. It is illustrated as having a front strap attachment 29 and a rear strap attachment 28 affixed to each of two foot plate attachments 30 on the side that faces inwardly. A front track bearing member 35 and a rear track bearing member 33 are affixed to the end of each track 20, the convex side of each member facing outwardly. On each of tracks 20, one end of strap 36 is attached to front strap attachment 29 and the other end is attached to rear strap attachment 28. Strap 36 is extended forwardly along track 20 from front strap attachment 29 in guideway 34 and around front track bearing member 35, then back down the other side of track 20 in guideway 34. It continuously travels around the rear track bearing member 33 and back up to rear strap attachment 28. In this embodiment, resistance to the user's movement of foot supports 32 in a forward and rearward direction is provided by friction created as straps 36 are pulled around the curved surfaces of front track bearing members 35 and rear track bearing members 33.

Figure 7:
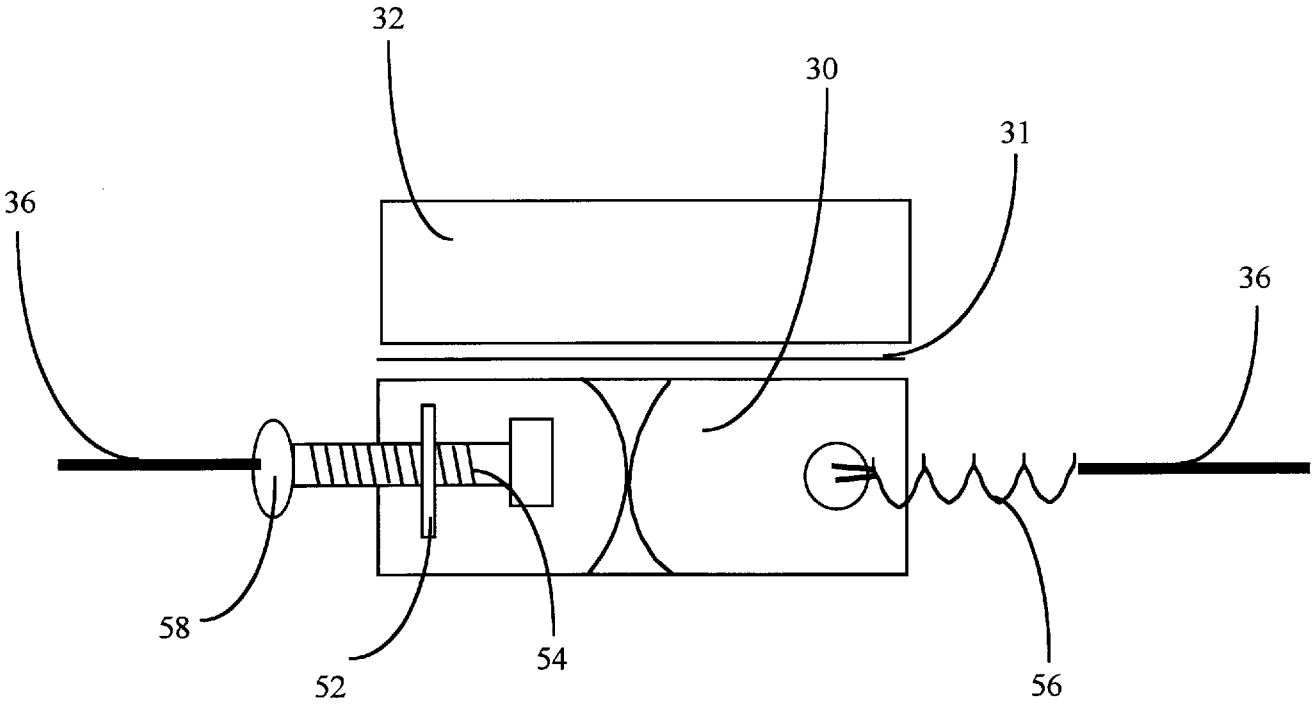
FIG. 7 is a side view of an embodiment of a foot support from FIG. 5 or FIG. 6, wherein the resistance is adjustable.

FIG. 7 shows an embodiment of foot support 32 from FIG. 5 or FIG. 6, wherein the resistance is adjustable. It is illustrated as having one end of a spring 56 attached to the inward side of foot plate attachment 30 and the other end of spring 56 is attached to one end of strap 36. A bolt attachment 52 with a central threaded hole is affixed to the inward side of foot plate attachment 30, opposite spring 56. A bolt 54 is threaded into bolt attachment and a strap harness 58 is affixed to the end of bolt 54. The other end of strap 36 is rotatably affixed to strap harness 58.

In use, turning bolt 54 clockwise will decrease the tension on strap 36, because spring 56 will contract. Turning bolt 54 counter clockwise will extend spring 56, which will increase tension on strap 36. Resistance to the movement of foot supports 32 is provided by the frictional engagement of strap 36 bearing against guideway 34 and the convex surface of front bearing member 39 and rear bearing member 37 bearing member of FIG. 5 or front track bearing member 35 and rear track bearing member 33 of FIG. 6.

SUMMARY, RAMIFICATIONS, AND SCOPE

Accordingly, the leg exerciser provides a mechanism formed of rigid metal components, which is extremely sturdy and durable in use. Its simple design lends itself to inexpensive manufacturing, which can be easily marketed to the consumer. It provides an effective, safe, and efficient device which can be used in a number of environments. A person could easily use it while working at a desk or while sitting on a couch. Given enough space, a person could even use it during travel in an airplane, train, or automobile. As a result, it is a superior method of exercise for users with time constraints.

The leg exerciser serves many purposes for the user including cardiovascular heath, muscle building, weight loss, and coordination. It does not require a great degree of physical fitness, balance, or muscularity. It accommodates users of different heights, weights, and levels of physical fitness. It allows for smooth, quiet resistance in the forward and rearward direction which provides a workout for all of the muscles of the legs. The leg exerciser is extremely versatile because it is manually driven and the level of resistance can be adjusted according to the user's needs. Therefore, it is an excellent device for rehabilitation after a leg injury or surgery.

While preferred embodiments have been illustrated in detail, the leg exerciser is not to be considered as limited thereto. It is to be realized that the optimum dimensional relationships for the parts of the invention, to include variation in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The following are non-exclusive examples of embodiments that would be readily apparent and obvious to one skilled in the art:

- a cable system attached to the foot supports and to a drive shaft(s), wherein a connected flywheel is engaged;
- foot supports with rollers that fit into slots on the tracks, wherein a surface is present that restricts the movements of the rollers as the foot supports travel forwardly and rearwardly along the tracks;
- elastic, stretchable cables or non-elastic cables attached to the foot supports as they travel along the tracks;
- a system of cams or clutches used to restrict the movement of a cable that is attached to the foot supports;

a system of rotable gears assembled in connection with the foot supports, wherein resistance to the movement of the foot supports is provided as the gears turn;

foot supports attached to cables that are also attached to weights, wherein the movement of the foot support causes weight(s) to be lifted;

the cable attached to the foot supports using a clamping mechanism;

a variable clamping mechanism attached to the cable to increase or decrease the resistance of the cable as it travels along the tracks;

a number of pulleys attached to the sides of the tracks to guide the cable or strap as it travels along the curved tracks, which would provide more surface area for resisting movement;

regular pulleys or variable resistance pulleys affixed to each end of the tracks or to the connections between the tracks, wherein the cable travels around;

a turn buckle or spool used in conjunction with a cable system attached to the foot supports, wherein the tension of the cable could be adjusted, resulting in increasing or decreasing resistance as the cable travels along resistant surfaces;

the foot supports secured to the tracks using a number of magnets;

resistance to the foot supports moving along the tracks accomplished using a system of magnets;

tracks of different sizes to better accommodate different users or different environments;

tracks of different angles of curvature to better accommodate different users or different environments, such as a user extending his or her legs from a horizontal position rather than a sitting position;

tracks made of different materials resulting in varying density, texture, weight, or pliancy;

tracks attached to each other in different ways, even to allow for adjustable space between them, for example, a rectangular support bar with a peg on the end attached to another bar with a series of peg holes;

foot supports made of different materials resulting in varying density, texture, weight, or pliancy;

foot supports of different sizes to better accommodate different users or different environments;

base frame made of different materials resulting in varying density, texture, weight, or pliancy;

base frame of different sizes to better accommodate different users or different environments;

the base frame and the tracks made integrally or separately;

the base frame, tracks and foot supports made of a variety of colors;

the two tracks eliminated and replaced by one wide track with two foot supports, wherein the user extends and contracts his or her legs in unison;

the user lies on the ground and extends each leg in the foot supports up and down the curved tracks;

attachments to the base frame or tracks that will allow the device to be permanently or temporarily affixed to a chair, table or desk;

attachments added for exercising the upper body of the user, such as vertical poles or handles connected to cables as with ski machines;

Therefore, the foregoing is considered as illustrative only of the principles of the leg exerciser. Further, since numerous modification and changes will readily occur to those skilled in the art, it is not desired to limit the invention to the exact construction and operation shown and described. Accordingly, all suitable modification and equivalents may be resorted to, falling within the scope of the invention as set forth in the following claims.

I claim:

1. A device for exercising the legs of a user, comprising:

a frame having a generally horizontal base having a distal end and a proximate end and a generally vertical base having a distal end and a proximate end extending from a proximate end of said generally horizontal base;

a pair of tracks each having a length;

said tracks extending between said distal end of said generally vertical base and said distal end of said generally horizontal base; and a pair of foot supports each reciprocatingly mounted on one of said tracks;

wherein said tracks are curved upwardly to such an extent that the user can move said foot supports the entire lengths of said tracks only from a generally sitting position.

2. The exercising device of claim 1 further comprising a means for individually resisting the reciprocating movement of said foot supports along the lengths of said tracks.

3. The exercise device of claim 2 wherein said resistance means comprises a hydraulic cylinder mounted between said frame and each of said foot supports.

4. The exercise device of claim 2 wherein said resistance means comprises a hydraulic cylinder mounted between said generally horizontal base and each of said foot supports.

5. The exercise device of claim 3 wherein each of said hydraulic cylinders has a knob for adjusting the level of resistance.

6. The exercise device of claim 2 wherein said tracks have upper and lower ends and wherein said resistance means comprises:

an upper bearing member positioned adjacent said upper end of each of said tracks;

a lower bearing member positioned adjacent said lower end of each of said tracks; and a first flexible belt fixedly attached to said first foot support and positioned around said bearing members on said first track;

a second flexible belt fixedly attached to said second foot support and positioned around said bearing members on said second track;

wherein resistance is generated by the friction of said belts passing over said bearing members.

7. The exercise device of claim 6 wherein said resistance means further comprises a first spring positioned between a first end of said first belt and said first foot support, a first means for adjusting a length of said first belt positioned between a second end of said first belt and said first foot support, a second spring positioned between a first end of said second belt and said second foot support and a second means for adjusting a length of said second belt positioned between said second end of said second belt and said second foot support, whereby decreasing the length of said belts increases the friction between said belt and said bearing members thereby increasing the resistance of the exercise device.

8. The exercising device of claim 1 further comprising a means for simultaneously resisting the reciprocating movement of each of said foot supports along the lengths of said tracks.

9. The exercise device of claim 8 wherein said tracks have upper and lower ends and wherein said resistance means comprises:

an upper bearing member positioned between said upper ends of said tracks;

a lower bearing member positioned between said lower ends of said tracks; and a flexible belt fixedly attached to said foot supports and positioned around said bearing members;

wherein resistance is generated by the friction of said belt passing over said bearing members.

10. The exercise device of claim 9 wherein said bearing members have a generally arcuate shape to prevent said belt from catching.

11. The exercise device of claim 9 wherein said resistance means further comprises at least one spring positioned between a first end of said belt a first foot support and a means for adjusting a length of said belt positioned between said second end of said belt and said first foot supports, whereby decreasing the length of said belt increases the friction between said belt and said bearing members thereby increasing the resistance of the exercise device.

12. The exercising device of claim 1 wherein said generally horizontal base further comprises a pair of detachable base members and said generally vertical base further comprises a pair of detachable base members.

13. The exercise device of claim 1 further comprising a means for carrying the exercise device during transport.

14. The exercise device of claim 13 wherein said carrying means comprises two handles secured to said frame.

15. A device for exercising the legs of a user while in the sitting position, comprising:

a frame having a generally horizontal base having a distal end and a proximate end and a generally vertical base having a distal end and a proximate end extending from a proximate end of said generally horizontal base;

a pair of arcuate tracks mounted to said frame;

each of said tracks having a first end oriented in a generally horizontal manner and a second end oriented in a generally vertical manner; and a pair of foot supports each reciprocatingly mounted on one of said tracks.

16. The exercising device of claim 15 further comprising a means for individually resisting the reciprocating movement of said foot supports.

17. A device for exercising the legs of a user while in the sitting position, comprising:

a frame;

a pair of arcuate tracks mounted to said frame;

each of said tracks having a first end oriented in a generally horizontal manner and a second end oriented in a generally vertical manner; and a pair of foot supports each reciprocatingly mounted on one of said tracks.

18. The exercising device of claim 17 further comprising a means for individually resisting the reciprocating movement of said foot supports.

* * * * *